US005554042A

United States Patent [19]

Denninger

[11] Patent Number: 5,554,042

[45] Date of Patent: Sep. 10, 1996

[54] RESILIENT BODY ELECTRICAL CONNECTOR SYSTEM

[75] Inventor: Valentine L. Denninger, Sunnyvale, Calif.

[73] Assignee: Trimble Navigation, Limited, Sunnyvale, Calif.

[21] Appl. No.: 395,689

[22] Filed: Feb. 28, 1995

[51] Int. Cl.[6] ..... H01R 13/52

[52] U.S. Cl. ..... 439/272; 439/354; 439/660; 439/676

[58] Field of Search ..... 439/271–274, 439/292–295, 341–344, 354, 284, 660, 676, 374, 933, 95

[56] References Cited

U.S. PATENT DOCUMENTS 4,481,458 11/1984 Lane ..... 439/660

*Primary Examiner*—Neil Abrams
*Assistant Examiner*—Brian J. Biggi
*Attorney, Agent, or Firm*—George M. Steres

[57] ABSTRACT

A resilient body electrical connector is shaped and dimensioned to define at least one mating interface parallel to a longitudinal axis. A first plurality of electrical conductors is disposed with each having a portion embedded in the connector body, and each having a respective contact point protruding from the connector body, the contact points being disposed in a contact plane parallel to the mating interface. A receptacle is configured to slidably receive the mating interface along a complementary receiving interface. A second corresponding plurality of electrical conductors are embedded in the receptacle and define respective contact faces disposed along the complementary receiving interface. The connector and receptacle are shaped and dimensioned such that they define a guide means, the guide means being configured to guide the connector as it is inserted longitudinally into the receptacle such that the contact surfaces slidably receive the contact points. The connector and receptacle are provided with a latching means for removably latching the connector into a contact position with the receptacle with the respective contact points and contact faces in electrical contact. A wiper means for removing adherent materials from the complementary receiving surface, before the connector is slidably located in the contact position, while the connector is inserted into the receptacle, is mounted on the connector. An outlet means is provided on the receptacle, for receiving such adherent material after removal from the receiving surface. In a preferred embodiment of the resilient body connector, at least one side defining a mating interface includes a resilient gasket layer for compressively sealing against the complementary receiving interface. The gasket layer is provided with recesses encompassing the conductor contact points.

33 Claims, 5 Drawing Sheets

RESILIENT BODY ELECTRICAL CONNECTOR SYSTEM

BACKGROUND OF THE INVENTION

FIELD OF THE INVENTION

The present invention relates generally to electrical connectors with mating receptacles for use in severe environments in which self-cleaning wiping contacts are embedded in sealed bodies. More particularly, the invention relates to connectors and receptacles including mating contacts mounted in one or more semi-resilient bodies providing normal contacting force between mating surfaces during engagement of the connector with the receptacle. In addition, a wiping member may be provided to remove contamination or debris from mating surfaces and contacts prior to contact engagement.

BACKGROUND

Operation of electrical equipment in field operations outdoors can be characterized as a severe environment for making electrical connection with standard connectors and receptacles. The presence of dirt, dust and moisture can combine to defeat good electrical contact between contacting surfaces. Particles of dust or a layer of mud on a receiving conductor surface may prevent a contact pin from physically touching the conductor. A conventional tubular projecting pin and socket configuration may be inoperative if mud is compacted into the receiving socket. It can be difficult, if not impossible, for an operator in the field to clean out the sockets of a receptacle if they become clogged with mud.

A soldier in the field, for example, is responsible for keeping vital equipment such as his rifle or connecting cables, clean and ready to use. Conventional pin and socket connectors are inherently difficult to protect from contamination and difficult to clean.

Receptacles which are mounted or molded directly into the case of a piece of electrical equipment become particularly difficult to clean since they cannot be simply tapped or knocked against the hand or other objects without risking damage to the electrical circuits and components inside the case.

The connector art is replete with teachings of contact structures having conductive metal elements formed into spring like members, making sliding or wiping contact with planar receiving contact surfaces. These can be characterized as having complex multi-curvilinear conductor shapes which depend on the resilient distortion of one or more of the conductor elements to provide wiping action. Manufacturing these complex shapes requires expensive stamping, bending and finishing operations. These structures also are not very tolerant to removal of dirt or mud which lodge in recessed channels or re-entrant cavities or hollow internal volumes.

Expensive beryllium, nickel, copper alloys of complex form are generally used for the conductive spring like elements to provide the desired high conductivity and retention of spring characteristics. Surface treatment of contact points, such as plating with rhodium or palladium, is used to improve wearability but add cost due to the complex shape of the plated element.

PREVIOUS ART

Giannini, U.S. Pat. No. 4,844,582, teaches a combined electrical/optical connector pair having axial joining, magnetically aligned, pressure capable, frusto-conical channels and complex form; and Ushler U.S. Pat. No. 4,960,395, shows a twist action locking plug and socket having a conical surface. for high current operation. These structures are not very tolerant to removal of dirt or mud which lodge in the recessed channels.

Hamsher U.S. Pat. No. 4,303,294, teaches a PC board edge connector with multiple segments of cam operated springs having wiping action of contacts against PC board edge pads; Riechalmann U.S. Pat. No. 4,964,808 shows impedance matched resilient strips in slots above a resilient conducive sheet. in which wiping action is provided by spring distortion of the strips; and Walkup U.S. Pat. No. 5,273,446 teaches a connector having wiping contacts in which separation force is reduced by a complex spring geometry.

Connectors using complex spring geometries may be subject to contamination when used in outdoor environments. Even with the wiping action of the conductive elements, the complex recursive shapes mounted adjacent to encasing walls and surfaces are susceptible to becoming jammed with dirt or mud and not being easily cleaned.

It would also be an advantage to have electrical connectors with wiping contacts which are less dependent on complex spring geometries and special metal alloys in order to reduce cost. It would be an additional advantage to reduce the likelihood of dirt, dust or mud jamming the operation of such connectors.

Goble U.S. Pat. No. 5,104,331 teaches a latching electrical power connector, that includes a substantially solid block female component with a housing having a concave curved surface with a plurality of electrical contacts on that surface and a substantially solid block male component with a housing having a convex curved surface with a plurality of electrical contacts on that surface. The contacts on one surface are positioned on raised lands, and the contacts on the other surface are positioned in corresponding grooves. A pin secured to one of the housings and positioned on the axis of that curved surface cooperates with notch means on the other housing positioned on the axis of that curved surface to allow the two surfaces to rotate together with the electrical contacts in sliding engagement. As the surfaces are rotated into closed position, the lands enter the grooves and make contact with the receiving contacts. Interference fit between male and female contacts and springy bent regions or dimples on the contacts or slightly resilient mounting block material is provided to maintain contacts in pressure engagement.

Goble teaches that the materials of the male and female component may be made of metal, plastics, ceramics, wood, synthetic or natural rubber, rigid or semi-rigid foam and combinations thereof. Best results are obtained where the internal, electrical contact supporting bodies are formed from semi-rigid plastic foams, such as polyurethane, polyimide and polyamide foams and combinations or mixtures thereof. A rigid external housing of metal or high strength plastics may be provided to give resistance to damage from crushing, impact or other external forces. Goble also teaches taping the engaging edges of the closed housing to prevent access of liquids to the contacts within.

While useful in heavy duty power applications, this structure still has the disadvantage in that there is opportunity for the recessed grooves and or concave surfaces to become packed with dirt or mud, when not connected, which may not be easily removed and which may effect the ease of closing the housings and thus the reliability of the contact.

In one aspect of supplying connectors to the U.S. government, in the majority of cases other than conditions where cables are coupled and uncoupled under water, it is the carrier's responsibility to keep cables clean. If cables do get mud or dirt on them, they should be easy to tap on one's hand to remove such contamination. It is generally not easy to handle something large, such as a radio, and tap it on one's hand with enough shock to knock off dirt or mud. Therefore, receiving receptacles which are mounted on equipment enclosures and the like should have essentially flat surfaces for easily removing contamination therefrom.

It is desirable to have improved electrical connectors with wiping contacts that are less susceptible to contamination by dirt, dust, moisture and the like which are made with low cost materials and manufacturing methods. It is also a continuing need for improved electrical connectors wherein the connector contacts are intrinsically sealed from the surroundings by a simple autonomous means.

In another aspect of military field operations, there is the desirability of having two or more connectors for the same piece of equipment, which use the same technology, but have easily identifiable unique shapes for fast, reliable connection in times of stress. For connectors using complex spring geometries, it is difficult to provide variety in the shape of the connector, while maintaining the same conductor geometry. It is an advantage to have connector technology which lends itself to relatively low cost modification.

Elastomeric connectors having alternate parallel laminated conductive and insulating layers are known in the art. One commercial type is known as "FUJI POLY ZEBRA" connectors and am available from Fujipoly, Cranford, N.J. "ZEBRA" connectors depend on compressive contact and elastic deformation of the elastomer layers filled with silver particles or fine metal wires parallel to the plane of lamination. "ZEBRA" connectors depend on compressive forces for the particles or wires to penetrate surface oxides or contaminant layers to make electrical contact to conductor surfaces and thus are not suitable for dirty or dusty environments.

SUMMARY OF THE INVENTION

An electrical connector assembly is comprised of a resilient insulating connector body defining a longitudinal axis, the connector body including a resilient gasket layer and a contiguous resilient second body member. The resilient gasket layer defines one side having a slidably smooth outward facing connector mating interface. The gasket layer has the other side bonded to the second body member thereby being disposed between the connector mating interface and the second body member.

A receptacle is configured having a complementary mating interface for slidably receiving the connector mating interface as the connector is moved along the longitudinal axis.

A plurality of spaced apart first electrical conductors, are partially embedded in the connector body. Each conductor includes a one end with a corresponding contact point, and a corresponding opposed connection end. A portion of each of the conductors and each connection end being embedded within the second body member such that, each of the respective conductor contact points protrudes outside the second body member. The contact points are each disposed in the interior of a corresponding recess opening defined in the resilient gasket layer and connector mating interface. The contact points are aligned in a plane parallel to the connector mating interface, thereby defining a contact plane. The points preferably are formed each having a smooth semi-circular contour, the contour parallel to the longitudinal axis.

There is provided a guide means for urging the connector body toward the connector mating interface such that the connector mating interface and the respective conductor contact points will simultaneously make intimate sliding contact with the receptacle complementary mating interface by compressing the gasket layer against the receptacle complementary mating interface as the connector body is slidably moved longitudinally with respect to the receptacle complementary mating surface. The second body member, having a selected Shore hardness, is shaped and dimensioned to provide, in cooperation with a complementary shaped and dimensioned guide means, a normal force for holding the first electrical contacts against the second contact surfaces, when the connector is inserted in the receptacle.

A plurality of corresponding spaced apart second electrical conductors are embedded in the receptacle. Each second electrical conductor defines a corresponding planar contact surface. The respective contact surfaces are disposed along the receptacle complementary mating interface to slidably receive the corresponding connector contact points thereon, as the connector body is slidably moved into a predetermined contact position.

The sliding contact of the conductor contact points against the contact surfaces provides a wiping action to penetrate surface oxides and other surface contamination.

A latching means is provided for removably latching the connector body in registration with the receptacle such that the respective conductor contact points are aligned in contacting opposition with the corresponding receptacle second contact surfaces at the contact position.

The resilient connector and receptacle provide good electrical contact between each respective connector contact point and each corresponding receiving contact surface, and each electrical contact is sealed from external moisture and contamination.

The gasket layer may be made of an insulating material preferably having a Shore hardness in the range of about 35 to 60. The gasket layer provides a means for excluding external moisture from electrically connecting adjacent contact points after the connector is positioned in the receptacle.

The second body may be made of an elastomer preferably having a Shore hardness in the range of about 70 to 90.

The portion of each of the first electrical conductors embedded in the connector body each forms a waterproof seal between the portion and the second body by gluing, ultrasonic welding, setting in place with a thermosetting plastic or heating the conductors to the melting point of the body material and inserting the conductors therein.

In one preferred embodiment of the invention, a flexible wiper member is distally positioned on the connector body and projects beyond the connector mating interface such that the receptacle complementary mating interface and the second contact surfaces will be substantially wiped free of adherent materials when the connector is slidably positioned in the receptacle. The wiper member may include a plurality of corrugated ribs extending laterally at least as wide as the most extreme lateral extent of the corresponding receptacle contact faces. The receptacle may also define an distally disposed outlet for receiving adherent materials removed by the wiper when the connector is inserted in the receptacle. The wiper provides a means for removing relatively gross contamination in preparation for the wiping contact of the conductor contact points on the receptacle contact surfaces.

In a preferred embodiment of the invention, the protruding first electrical conductors are elongated cylindrical pins. The connector second body member includes a semi-rigid insulating matrix sheet having the pins embedded perpendicularly therethrough. The matrix sheet provides essentially rigid lateral support to the pins relative to each other along the plane of the sheet. The sheet being suitably flexible in a direction normal to the sheet for displacement of the pins relative to each other from forces exerted along the axes of the pins. The Shore hardness of the second body is selected to be in the range of about 70 to 90.

The latching means for holding the connector body in registration with the receptacle in the contact position includes a spring member molded in the connector body, the spring member shaped and dimensioned for cooperating with the receptacle, when the connector is inserted in the receptacle. The receptacle includes a latching ridge facing inward to the receptacle mating interface and the spring member includes a cooperating locking edge for removably locking with the latching ridge, when the connector is located in the contact position, whereby the connector is removably locked in connecting position with the receptacle.

Moisture and other adherent materials such as mud, dust and the like are excluded from any re-entrant concavities formed within the spring member and between the spring member and the second body by covering with a third elastomeric surface layer except for the gasket layer recesses.

BRIEF DESCRIPTION OF THE DRAWINGS

For a further understanding of the objects and advantages of the present invention, reference should be had to the following detailed description, taken in conjunction with the accompanying drawings, in which like parts are given like reference numerals and wherein.

DETAILED DESCRIPTION OF A PREFERRED EMBODIMENT OF THE INVENTION

With reference to FIGS. 1 through 12 there is shown one embodiment of a resilient body connector having self-cleaning contacts in accordance with the present invention. A generally wedge-shaped resilient multi-layer molded connector body is indicated by the numeral 50, and a rigid receiving receptacle is generally indicated by the numeral 52.

The connector body 50 includes at least one waterproof elastomeric material such as neoprene, butyl rubber, synthetic rubber, natural rubber, elastomeric polyurethane, silicone, thermoplastic and thermoset elastomers. The preferred Shore hardness range of various elastomeric materials used in different embodiments of the body 50 is between about 35 to 95 Shore A.

Figure 1:
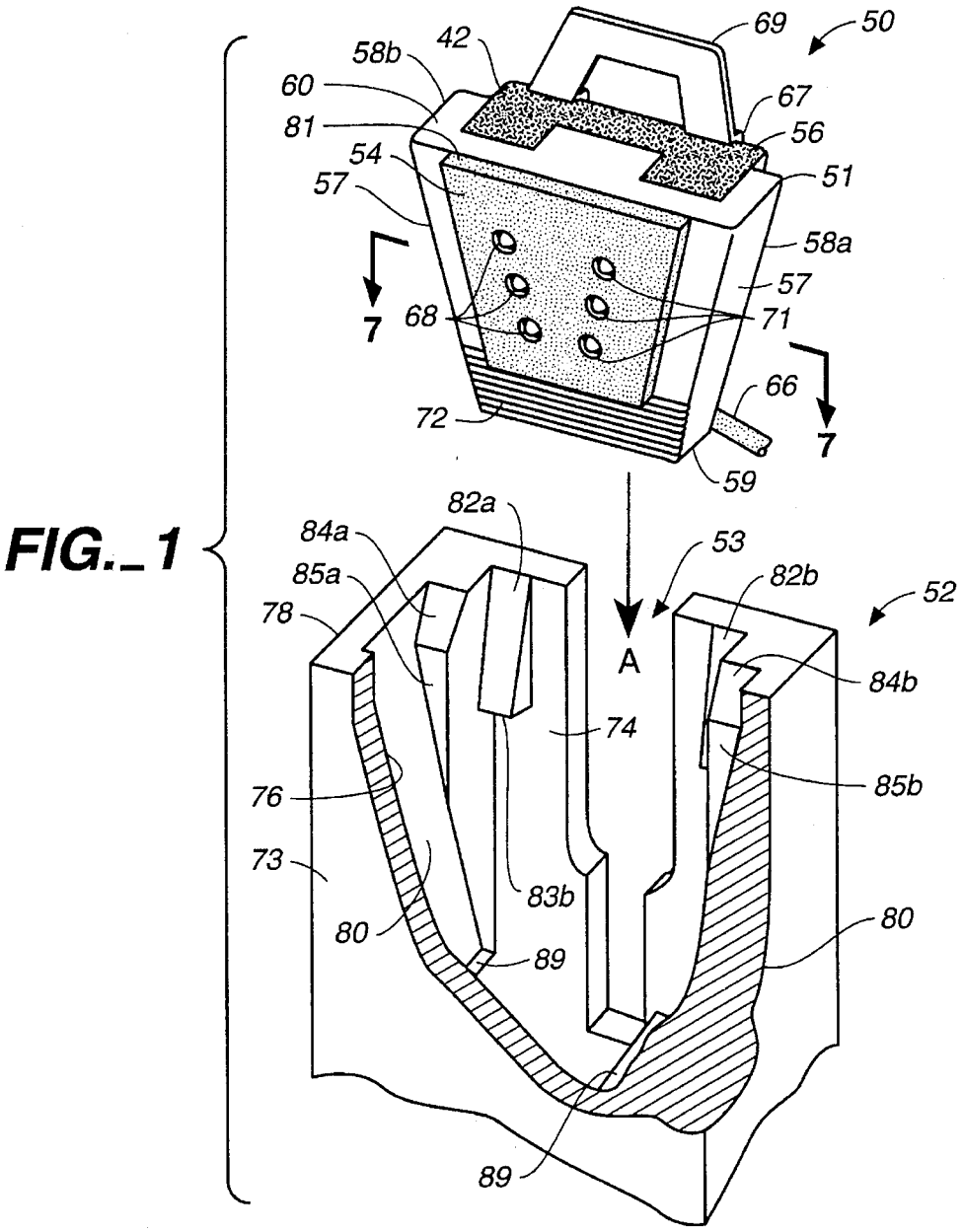
FIG. 1 is a partially cut away ¼ perspective exploded view of a resilient body connector and rigid receptacle system in accordance with this invention, shown from the connector mating side.
Figure 2:
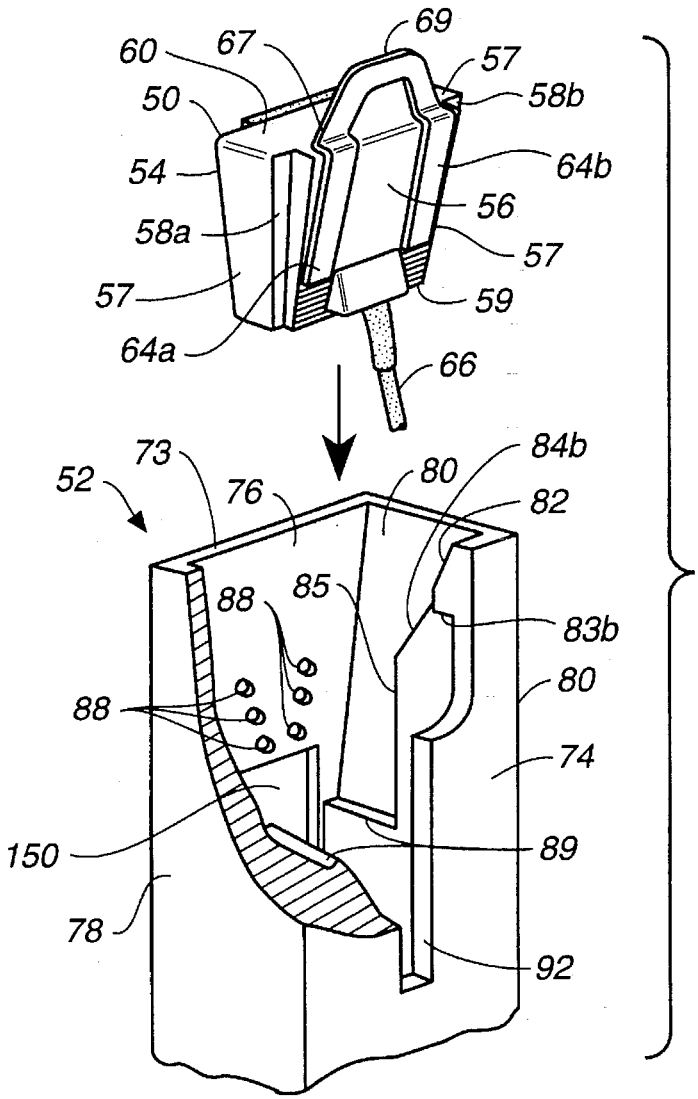
FIG. 2 is a partially cut away perspective exploded view of the connector system of FIG. 1, shown from the receptacle mating side.

With reference to FIGS. 1 and 2, the connector body 50 is shaped and dimensioned to present a tapered elevation cross section between a connector mating interface 54 and an opposed top surface 56 with thickness increasing from a distal end 59 to a proximal end 60. The body 50 also presents a tapered width cross section increasing between opposed sides 57 from the distal end 59 to the proximal end 60.

A proximal opening 53 of receptacle 52 receives the connector body 50 along a longitudinal axis indicated with the letter A as the distal end 59 of the body 50 is inserted therein. The narrower distal end 59 of connector 50 provides easy entrance into the proximal opening 53 of the receptacle 52.

The top surface 56 is symmetrically recessed inwardly at the opposed lateral sides 57 to provide two laterally disposed planar guide shoulders 58*a, b*. The planar guide shoulders 58*a, b* extend from the distal end 59 to the proximal end 60 of the body 50 and are parallel to the mating interface 54.

Figure 4:
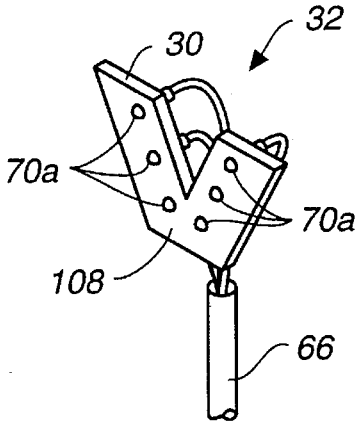
FIG. 4 is a ¼ bottom perspective view of the conductor matrix support unit of FIG. 3.
Figure 5:
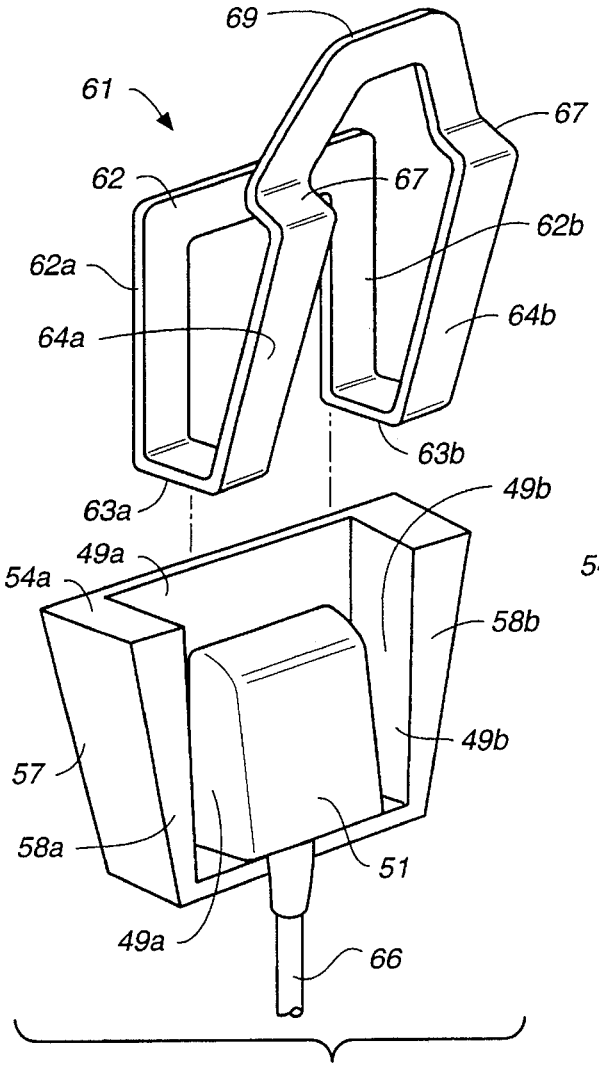
FIG. 5 is an exploded perspective view of a spring member element and a molded intermediate body member included in one embodiment of the invention shown in FIG. 1.

With reference to FIGS. 1, 4 and 5, a multi-conductor cable 66 containing a plurality of individually insulated wires 66*a*, extends from the distal end 60 of the body 50 to connect distally with auxiliary equipment (not shown).

With reference to FIGS. 3, 4, 5, and 6 there are shown elements internal to the body of one embodiment of the connector 50 in accordance with this invention. A V-shaped inner dielectric body 30 having a distal end at the base of the V and a proximal end at the open end of the V, provides support for a plurality of spaced apart juxtaposed electrical conductor pins 68. One face of the dielectric body 30 defines a reference face 108. The dielectric body 30 presents a thin, wide planar aspect having substantial rigidity in a direction perpendicular to the conductors 68 mounted therein, but having substantial flexibility in a direction normal to the planar aspect. The thickness of the sheet 30 is sufficiently thin to have suitable resilience in a direction normal to the sheet 30, such that the conductors 68 maintain contact with a receptacle mating interface, to be described, as the contacts are slidingly moved along the mating interface. The body 30 thus provides a matrix for precisely locating the pins 68 with respect to one another and subsequently to respective contact receiving surfaces (to be described). The body 30 also provides for ease of handling in subsequent molding operations.

The dielectric body 30 may typically be a rigid, non-conductive rigid thermoplastic, reinforced or unreinforced, including but not limited to poly-ether-ether-ketone (PEEK), polycarbonate, ABS, nylon, polyimide, polyamide and PPS. The matrix body 30 may also be a semi-rigid sheet of dielectric material such as G-4 or G-10 epoxy fiberglass, perforated, punched or drilled to receive the conductors 68 therethrough. The pins 68 may also be placed in a die mold (not shown) to be embedded as a molding material is formed into the body 30. The matrix sheet 30 provides an essentially rigid platform for transversely locating the conductors 68 in spaced apart relationship in the plane of the sheet.

Figure 3:
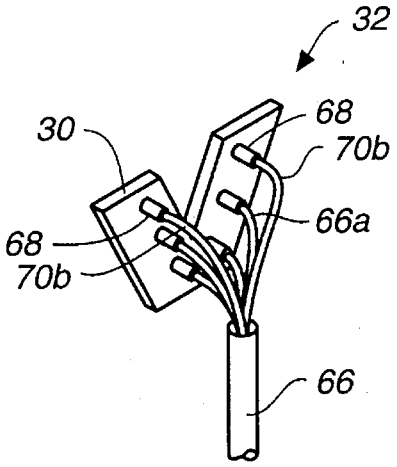
FIG. 3 is a ¼ top perspective view of a conductor matrix support unit included in one embodiment of the present invention of FIG. 1.

The pins 68 are disposed symmetrically along each arm of the V-shaped body 30. With reference to FIGS. 3 and 4, the electrical conductors 68 each having a contact point 70*a* and an opposite connection end 70*b* are mounted to project normally through holes provided in the dielectric matrix sheet 30 with the opposed ends of the conductors 68 disposed on opposite sides of the sheet 30. The contact points 70*a* project outwardly from the body 30 and lie in a contact plane, P, spaced a distance, d, away from and parallel to the face 108. One end, 70*b* of each of the pins 68 is individually connected to one of the insulated wires 66*a*. The respective conductors 68 and wires 66*a* may be electrically connected by solder, welding or crimping by means well known in the art. The wires 66*a* are individually insulated and enclosed in a covering to form the conventional cable 66 extending distally from the body 30 to connect with external equipment (not shown). The pins 68 are typically 1.75 mm (0.069 inch) to 2.29 mm (0.09 inch) diameter, spaced on 3.8 mm (0.15 inch) to 6.1 mm (0.24 inch) centers. The pins 68 are typically made of conductive metals such as brass, copper, beryllium copper, phosphor bronze, silver and gold. Plating with inert metals such as rhodium and platinum for surface oxidation resistance can also be employed. Each contact point 70*a* of each of the conductors 68 is provided with a smoothed surface for making sliding contact with a mating interface of the receptacle 52, described below.

The conductors 68 may be press fit or molded into receiving holes (not shown) defined in the dielectric matrix 30 by molding, drilling, punching or pressing, and fixed in place by molding, gluing, ultrasonic welding or the like to form water tight seals between the perimeter of the conductors 68 and the matrix material 30.

Figure 6:
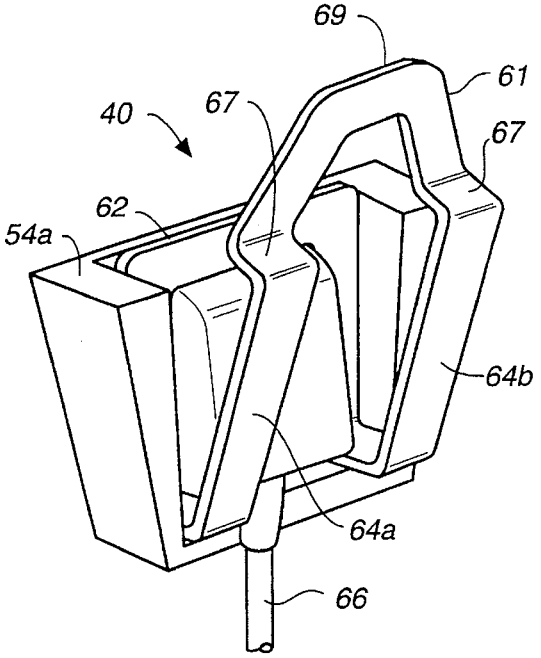
FIG. 6 is a perspective view of the spring member inserted in the molded intermediate body member of FIG. 5.
Figure 7:
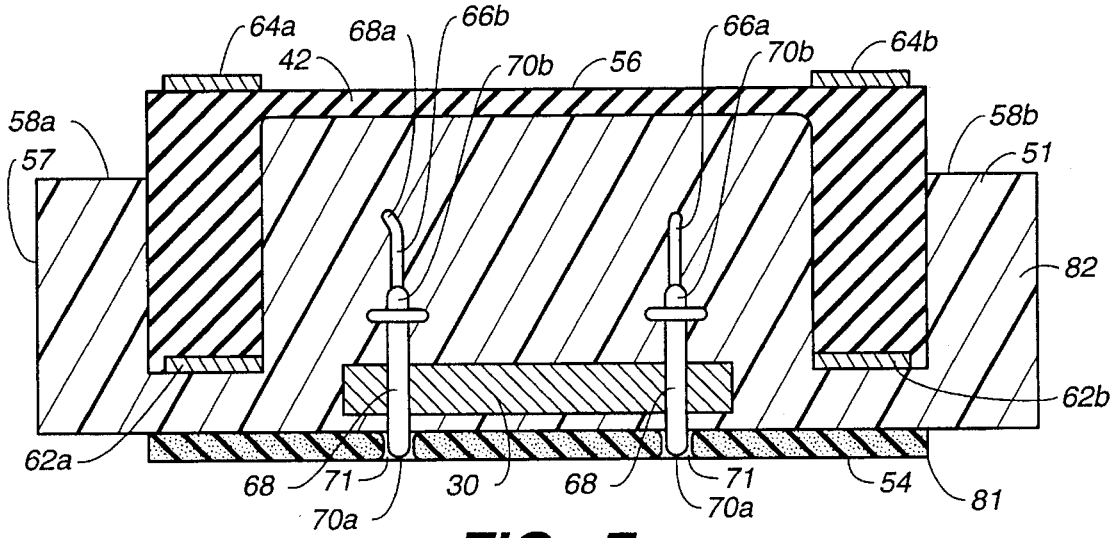
FIG. 7 is a cross section taken along line 7—7 of FIG. 1.

With reference to FIGS. 5, 6 and 7, a second elastomer may be molded over the dielectric body 30 to form an outer body 51. The alternatives afforded by choosing different materials for the inner body 30 and the enclosing outer body 51 provides an opportunity to optimize several different characteristics of the connector 50. For example, one material can be selected to provide optimal characteristics such as lateral rigidity and transverse flexibility for the pin support while another material can be selected to optimize resistance to temperature extremes and nuclear, biological, chemical, (NBC) attack and moisture resistance. For example, the material of the body 30 may be selected to have high strength and thermal stability for precision of pin location, whereas the material for the enclosing body 51 may be selected for resistance to moisture and NBC attack.

The body 51 may be molded into a different shape than the V-shape of the first body 30. The shape of the outer body 51 may be selected to conform to a predetermined configuration. For example, it would be convenient to define a series of connectors having similar contact geometry but unique shapes. This would be an advantage in order to clearly differentiate between two or more cables used to connect subassemblies, such as speakers, microphones, power supplies and the like, to a common piece of equipment With reference to FIGS. 5 and 6 there is shown a perspective view of the insulating resilient second body 51. With reference to FIG. 7 there is shown a front elevation cross section view taken along the line 11—11 of FIG. 1 of the connector body 50. The second body 51 is molded of a different resilient moisture proof elastomer such as neoprene, fluorosilicone, natural or synthetic rubber, polyurethane, silicone, thermoplastic elastomers and thermoset elastomers. The body 51 may be made of an elastomer having a durometer value different from that of the matrix body 30. For example, to provide improved resistance to NBC attack, the body 51 may be molded of a per-fluoroelastomer such as "KALREZ" made by Dupont Polymer Div, Wilmington, Del., or the like in the range of 70 to 90 Shore A hardness.

The second body 51 is molded to enclose the matrix sheet 30, the connection ends 70*b* of conductors 68 and the proximal end of the cable 66 to forms a unitary, moisture proof part of the connector body 50. The second body 51 is provided with laterally spaced apart recessed mounting channels 49*a* and 49*b*. With reference to FIG. 7, the contact ends 70*a* protrude from the body 51 as described further below. The channels 49*a*, 49*b* encompass the matrix 30 and conductors 68 therebetween and are configured for receiving a latching spring clip 61 therein as described further below.

With reference to FIGS. 5 and 6, the latching spring member 61 is formed of resilient flattened stock and includes an open frame U-shaped base section 62, two distal fulcrum segments 63*a,b* and two upper lever arm segments 64*a,b*. The spring clip 61 may be formed of metal, such as spring steel, beryllium copper, or a reinforced resilient plastic such as carbon, aramid, or glass reinforced thermosetting resin. The base section 62 includes laterally spaced apart arm segments 62*a*, 62*b* of the U and define a distally facing opening. The respective base arm segments 62*a*, 62*b* are embedded within the recessed channels 49*a* and 49*b* of the second body 51 and lie contiguous with the bottom of the recessed channels 49*a* and 49*b*, spaced away from and essentially parallel to the mating interface 54. The inner perimeter of the open frame of U-shaped section base 62 defines three sides of a rectangle partially encompassing the second body 51 containing the plurality of rigid elongated conductors 68 molded therein.

The distal ends of the spaced apart base section arm segments 62*a*, 62*b* deflect upwardly to form two distally extreme fulcrum segments 63 of the spring member 61. The fulcrum segments 63 continue further and inflect proximally to form the two laterally spaced apart lever arm segments 64. The lever arm segments 64 are inclined proximally away from the base section 62, from the fulcrum segments 63 at the distal end and define, at their inner surfaces, the top surface 56. The lever arm segments 64 extend along the top surface 56 to a point adjacent to the proximal end of the body 50 whereat each lever arm segment 64 is alternately bent inward and outward to each form indented saw-tooth notches 67 for cooperating with the upper wall 74 as described below.

With reference to FIG. 6, the base 62 and lever arms 64*a*, 64*b*, inserted in the channels of the body 51, form a re-entrant cavity 40 therein. In severe environments, characterized by heavy exposure to dirt, dust, mud and the like, the cavity 40 could become impacted with mud and interfere with compression of the spring arms 64*a*, 64*b* toward the base 62, thereby preventing operation of the spring clip 61.

Referring again to FIG. 1 and FIG. 7, to prevent contaminating mud or dirt from interfering with the operation of the spring clip 61, the cavity 40 is infilled with a third elastomeric layer 42 to exclude contamination from the cavity 40. The layer 42 may also be formed to provide a final moisture and dirt seal for the pins 68 and the cable 66. The layer 42 preferably comprises of a soft, resilient foam such as closed cellular meoprene, polyurethane, or polyethylene foam. In other embodiments of this invention, a connector formed of intermediate elements having similar re-entrant cavities may have a third layer molded to similarly exclude moisture and dirt from interfering with operation of a cooperating latching spring.

With reference to FIG. 1 and FIG. 6, the spring action formed by the base 62 and the lever arms 64*a*, 64*b* provide an urging force opposing compression of the body 50 between the mating interface 54 and the top surfaces of lever arms 64*a* and 64*b*. A cross piece 69 forms a handle connecting proximal ends of the lever arms 64*a*, 64*b* for actuating the spring clip 61.

The proximal ends of the lever arm segments 64 are yoked together to form the handle 69. The handle 69 projects proximally outward from the proximal end of the body 50. The elevation taper of the molded body 50 and the incline of the lever arm segments 64 are arranged such that the lever arm segments present smooth sliding surfaces thereon.

With reference to FIGS. 1, 2, and 8–12, the receptacle 52 comprises a generally rectangular hollow shell which includes a lower mounting wall 73, an upper retaining wall 74 and two opposed side walls 78 and 80 for slidably enclosing the connector 50 therein. The interior of the lower wall 73 forms a mating interface 76. The mating interface 76 is complementarily configured for slidably receiving the connector mating interface 54 and the respective conductor 68 contact points 70*a* as the connector 50 is slidably inserted into the receptacle 52. The mounting wall 73 is configured to mount on or preferably be molded integrally as part of a piece of electronic equipment (not shown) to which the connector 50 is to be connected.. The receptacle 52 may be molded of any rigid thermoplastic, reinforced or unreinforced, including but not limited to poly-ether-ether-ketone (PEEK), polycarbonate, ABS, nylon, polyimide, polyamide and PPS.

Figure 8:
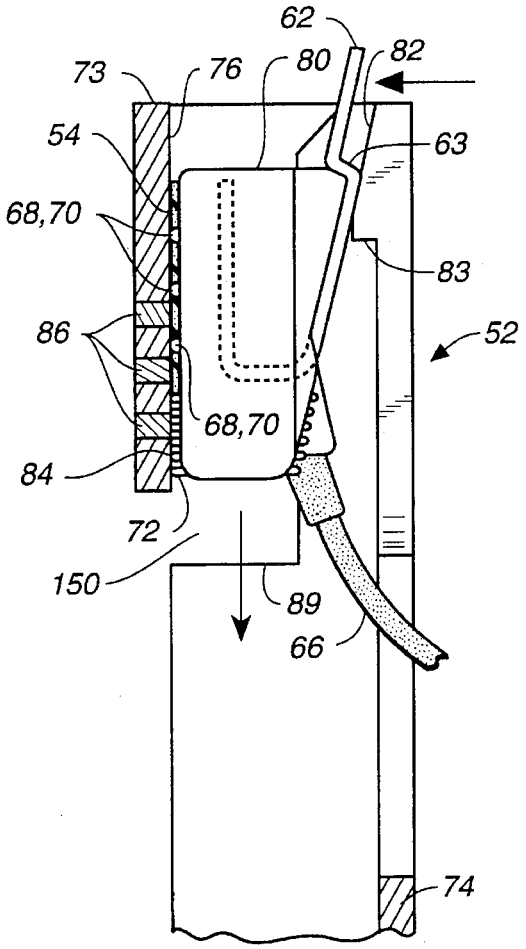
FIG. 8 is a partial cross section of the lower wall of the receptacle of FIG. 1 taken along line 8—8 of FIG. 11.
Figure 9:
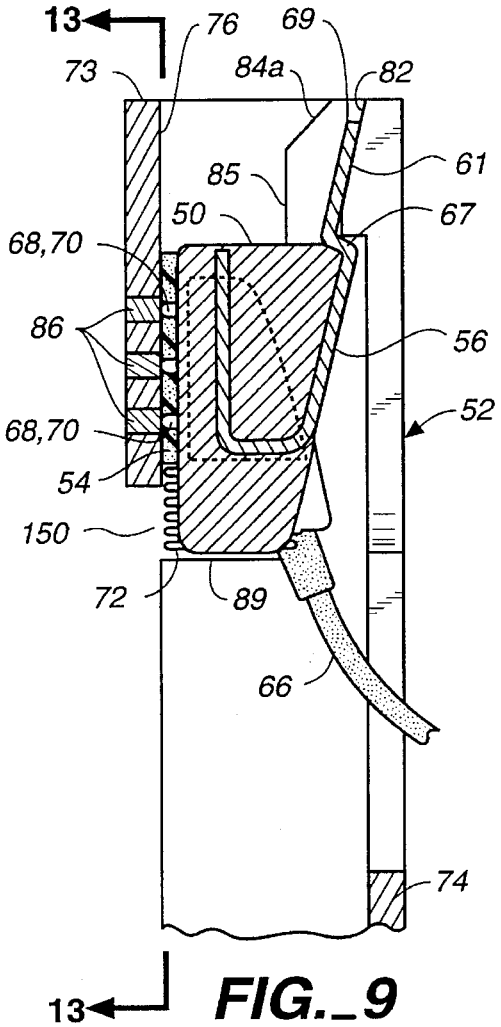
FIG. 9 is a cross section the lower wall of the receptacle and the connector taken along line 9—9 of FIG. 11.
Figure 12:
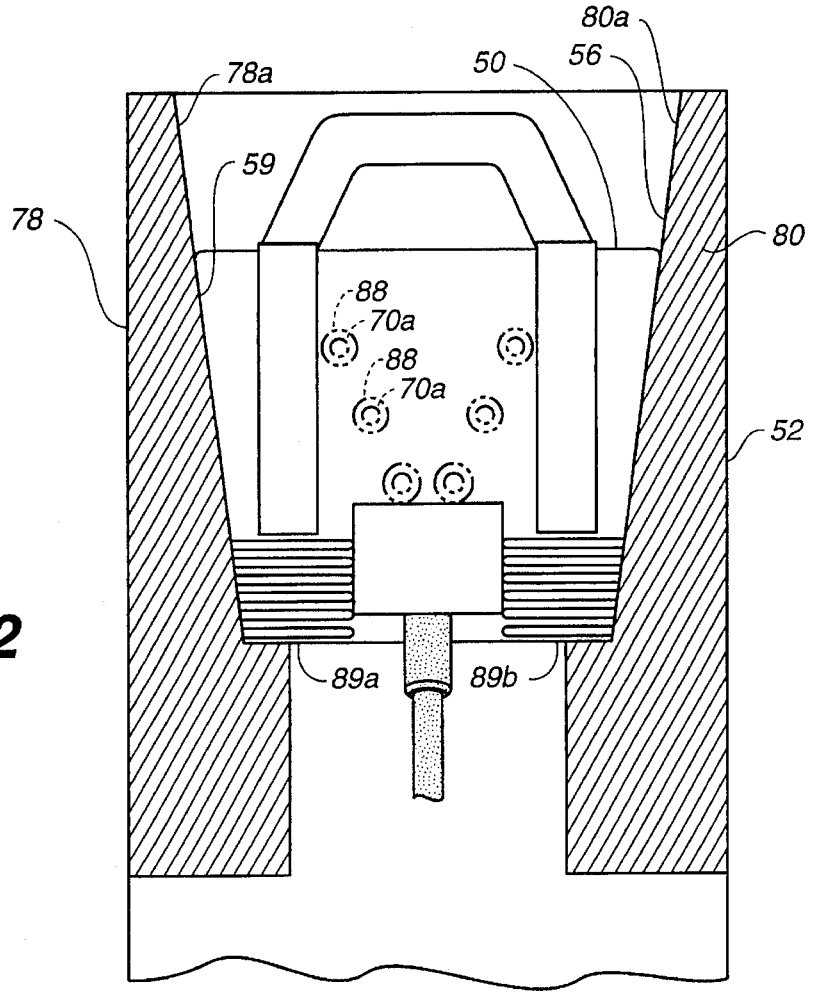
FIG. 12 is a plan cross section view of the connector inserted in the receptacle taken along line 12—12 of FIG. 11.

With reference to FIGS. 8 and 9, the connector 50 and receptacle 52 are shown in a cross section elevation view. FIG. 8 shows the connector 50 as partially inserted into the receptacle 52. FIG. 9 shows the connector 50 fully inserted and in final contact position in the receptacle 52. A plurality of embedded receiving conductors 86 extend through the lower wall 73. The receiving electrical conductors 86 are embedded in the lower wall 73 of the receptacle 52. The conductors 86 are molded or glued in the lower wall 73 to form water proof seals with the lower wall 73. With reference to FIGS. 1 and 12, the conductors 86 are provided with contact faces 88 co-planar with the receptacle mating interface 76.

The planar contact faces 88, as opposed to a concave receiving surface, prevent the possibility of dirt, dust or mud from building up into non-conductive layers which cannot be easily wiped off. A concave receiving contact would be immune to the wiping action of a wiper moving across the surface of such a contact since the contamination would be below the surface of the plane on which the wiper would be moving. The conductors 86 are disposed along the surface 76 such that each receiving electrical contact face 88 is oppositely aligned with each corresponding connector contact point 70*a* when the connector 50 is located in the final connecting position shown in FIG. 9. The other end of each conductor 86 is connected to a insulated wire (not shown) for connecting to other components within the integral electronic equipment (not shown).

With reference to FIGS. 1, 7, 8 and 9 a resilient deformable layer 81 of the body 50 extends across the mating interface 54 to a depth, t, and forms a sealing gasket. The contact point 70*a* of each of the conductors 68 are disposed within the interior of corresponding surrounding recesses 71 in the gasket layer 81 such that the points 70*a* defines the contact plane, P, within the body 50 spaced away from the parallel mating interface 54. Each recess 71 encompasses the corresponding contact point 70*a* therein. The sides of the recesses 71 are spaced away from the conductors 68 such that the gasket layer 81 may be compressed until the points 70*a* are coplanar with the mating interface 54 without having interference between the conductors 68 and the gasket 81.

The gasket layer 81 provides protection for the conductor points 70*a* while the connector 50 is not connected. Any dirt or contamination on the surface of the interface 54 or in the recesses 71 may be removed by wiping or lightly tapping the connector 50 before insertion. The gasket layer 81 is formed from a water proof elastomer having a slippery surface such as neoprene, internally lubricated silicone, fluorosilicone, or polyurethane having a durometer range of about 35 to 60 Shore A.

With reference to FIGS. 1 and 9, a series of flexible rib wipers 72 are disposed at the distal end of the connector 50 and define wiping surfaces essentially coplanar to the connector face 54. The wipers 72 extend laterally across the connector face 54 at least as far as the maximum lateral extent of the contact points 70. The wipers 72 provide a means for removing adherent dirt and moisture from the receiving surface of the interior of the receptacle 52 as described below.

The base of the handle 62 and proximal end of the body 50 are configured to define the forward facing locking ridge 67 extending transversely across the body 50 to locate the body in the receptacle 52 as described further below.

With reference to FIGS. 1, 8, 9 and 10, the respective notches 67 are configured to align with two corresponding guide ramps 82*a* and 82*b* which extend transversely across symmetrically disposed portions of the upper wall 74. The guide ramps 82*a* and 82*b* taper distally inward from the proximal end of the receptacle 52 to terminate at transverse distal facing ridges 83*a* and 83*b*. The ridges 83*a* and 83*b* latch with the notches 67, and prevents the connector 50 from being pulled axially from the receptacle 54.

A second pair of guide ramp faces 84*a* and 84*b* are symmetrically disposed adjacent to the first guide ramps 82*a* and 82*b*, respectively, projecting inward from the inner surface of the upper retaining wall 74 and are inclined distally inward from the wall 74. The guide ramp faces 84*a* and 84*b* are configured to guide the respective shoulders 58*a* and 58*b* of the connector 50 longitudinally into the receptacle 52. The surface of the guide ramp 84*a* intersects a shoulder guide face 85*a*. The surface of the guide ramp 84*b* intersects a corresponding shoulder guide face 85*b*. The shoulder guide faces 85*a* and 85*b* are aligned parallel to the mating interface 76 of lower wall 73 of the receptacle and spaced apart from the mating interface 76 such that a compressive interference fit exists when the shoulders 58*a* and 58*b*, respectively, of the connector 50 and the contact points 70*a* are positioned between the mating interface 76 of the receptacle lower wall 73 and the corresponding guide faces 85*a* and 85*b*. The compressive interference causes the shoulder 58*a* and 58*b* of the resilient body 51 of connector 50 to compress and force the contact points 70*a* into sliding contact with the receptacle mating interface 76.

The uncompressed thicknesses of the respective regions of the body 50, from the mating interface 54 to the shoulder 58*a* and 58*b* are selected to be greater than the corresponding spacings between the receptacle mating surface 76 and the respective shoulder guide faces 85*a* and 85*b*. The gasket layer 81 will therefore compressively deform as the connector 50 is inserted in the receptacle 52 until the contacts 70*a* make sliding contact with the receptacle interface 76. The connector mating interface 54 is in intimate sliding contact with the receptacle mating interface 76 and forms a moisture proof seal thereby.

Figure 11:
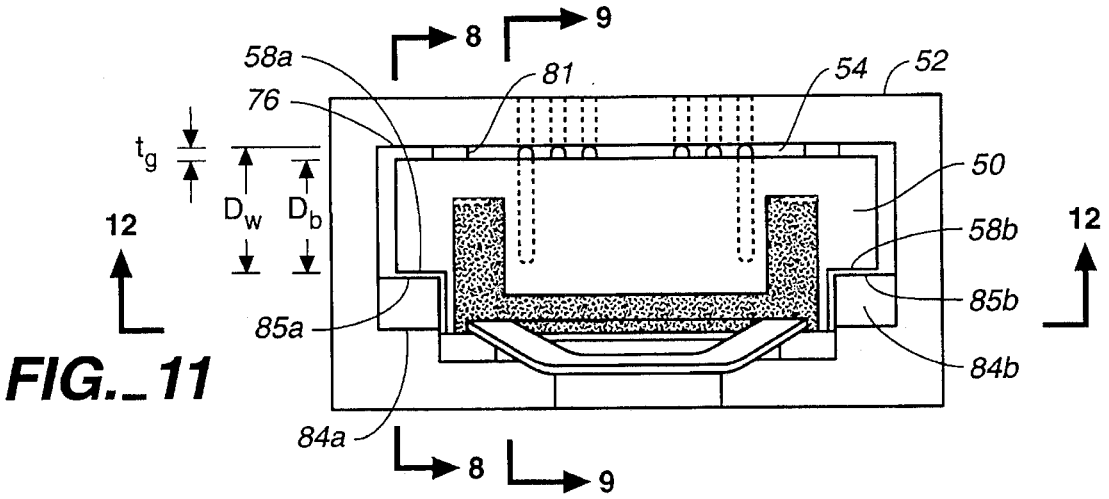
FIG. 11 is an end elevation view of the connector inserted in the receptacle.

With reference to FIG. 11, there is shown the connector 50 installed in the receptacle 52. The spacing between the guide faces 85*a, b* and the receptacle mating interface 76 is sufficiently less than the sum of the thicknesses of the gasket layer 81 and the distance between the body shoulders 58*a, b* and the bottom of the body 50, to opposedly compress the body 50 and gasket 81 therebetween. The Shore hardness of the constituents the body 50 are selected such that the body 50 will deform slightly to maintain a normal force holding the contacts 70*a* against the receptacle interface 76.

With reference to FIG. 9, there is shown a cross section elevation through conductors 68 and 86 of the receptacle wall 73 and connector 50 with the connector 50 in a final connecting position in the receptacle 52. Once the notches 67 pass the ridges 83*a* and 83*b*, the spring member 61 in the resilient body 50 begins to partially decompress. The handle 62 moves toward the upper wall 74 so the notches 67 and ridges 83*a*, 83*b* are latched. The wall ridge 83 and complementary connector notches 67 are engaged and prevent the connector 50 from loosening or being inadvertently withdrawn proximally from the receptacle 52. The contact faces 70*a* are thereby aligned in connecting opposition to the respective receiving conductors 86.

The resilience of the gasket layer 81 is selected so that it is compressed in the final latched connection position sufficiently that the respective contact points 70*a* disposed in the respective recesses 71 make good electrical contact with their corresponding receiving contact surfaces 88. The compressed layer 81 and the intimate contact between the mating surfaces 54 and 76 also provides a gasket which effectively seals the electrical contacts between conductor points 70*a* and 88 from dirt and moisture.

In order to form a reliable connection system, means must be provided to accurately locate the removable connector 50 in all three dimensions, e.g. longitudinally, laterally and vertically with respect to the receptacle 52. One embodiment of such guide means for guiding the connector 50 into connected alignment with the receptacle 52 will now be described.

With reference to the plan view of FIG. 12 and the end view of FIG. 11, the receptacle 52 is shown to provide two inward facing, tapered, guide ramp faces 78*a* and 80*a* and distal abutment shoulders 89 *a,b* laterally disposed on the interior of the opposite side walls 78, 80. The ramp faces 78*a* and 78*b* and the opposed connector side walls 57 are shaped and dimensioned to slidingly cooperate, such that the respective contact points 70*a* are guided into connecting alignment with the corresponding contact faces 88. Distal abutment shoulders 89*a*, 89*b* are shaped and dimensioned to prevent the distal end of the connector 50 from sliding too far distally in the receptacle 52.

The opposed tapered sides 57 of the connector 50 and the complementary opposed sidewalls 78, 80 of the receptacle 52 are shaped and dimensioned to position the respective contact surfaces 88 and contact points 70*a* in opposed alignment. Opposed shoulders 89*a* and 89*b* on the respective sidewalls 78, 80 are provided for positive longitudinal registration of the distal end of the connector 50 relative to the receptacle 52.

With reference again to FIGS. 8 and 9, the wipers 72 provide a wiping action against the receiving surface 76 and contact faces 88 as the connector 50 slides into the receptacle 52. Any contaminating material adhering to the surface 76 and faces 88 will be wiped away by the wipers 72 at the distal end of the connector 50 before the contact points 70*a* make contact with the faces 88. A recessed pathway 150 in the lower wall 73, distal to the receiving conductors 86, is provided for wiped away material to fall free of the receptacle 52 and connector 50.

Any residual film of insulating material remaining on the faces 88 of the conductors 86 will be penetrated by the contact points 70*a* as they slide into position. The planar shape of the receiving surface 88 and the contact points 70*a* prevent dirt, moisture and mud from building up. Prior art connectors frequently have complex resilient conductor springs and/or concave receiving sockets in which dust and moisture (mud) could build up and prevent electrical contact by an opposing contact pin. The wipers 72 of the present invention automatically remove contaminating materials, and the wiping action of the contact surfaces 54 against the receiving contact faces 88 breaks through residual films. The resilient elastomer of the gasket 81 and body 50 provide for sealing the electrical contacts of the present invention against moisture and dirt.

The resilience of the spring member 61 and the materials forming the connector 50 are selected to provide sufficient force to hold the connector 50 in latched position between the upper wall 74 and the lower wall 73 after insertion into the receptacle 52.

Figure 10:
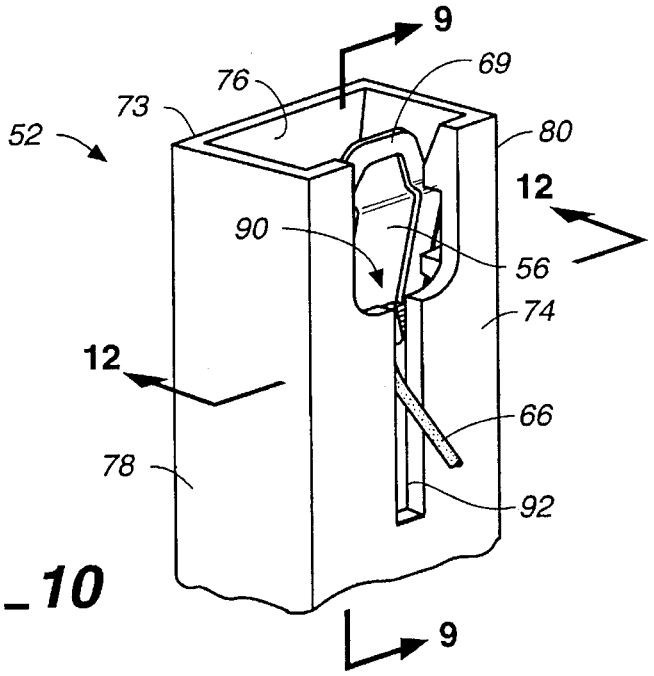
FIG. 10 is a perspective view of the connector mounted in the receptacle.

With reference to FIG. 2 and FIG. 10, there are shown perspective views of the connector 50 before and after insertion into the receptacle 52. The proximal end of the receptacle 52 provides an entry opening 90 narrowing to a cable slot 92 for receiving the connector 50 and cable 66. The entry opening 90 provides access to the handle 69 for connector 50 removal. The slot 92 provides a self guiding means for receiving the cable 66.

To install the connector 50, the cable 66 is aligned with the slot 92. The lower connector face 54 is positioned to face the lower wall 73 and the top surface 56 to face the upper wall 74. The connector opposed sides 57 face sidewalls 78, 80. The connector 50 may be pulled into latching engagement with the receptacle 52 by pulling distally on the cable 66. Or the connector 50 may be pushed into engagement by gripping the connector 50 proximal end, aligning the top 56 and bottom 54 faces of the connector 50 between the upper wall 74 and lower wall 73, and pushing distally and longitudinally toward the receptacle until the proximal ridges 83 latches into the handle notches 67 and the rear abutment 89 contacts the distal portion of the top surface 56. Whereby the wiper 72 wipes the receptacle mating interface 76 free of adherent materials (not shown), which materials exit through distally disposed outlet 150. The respective contact points 70*a* make wiping electrical contact with the corresponding contact surfaces 88 and the gasket layer 81 provides a moisture proof seal around the respective contact points 70*a* with the receptacle mating interface 76

Figure 13:
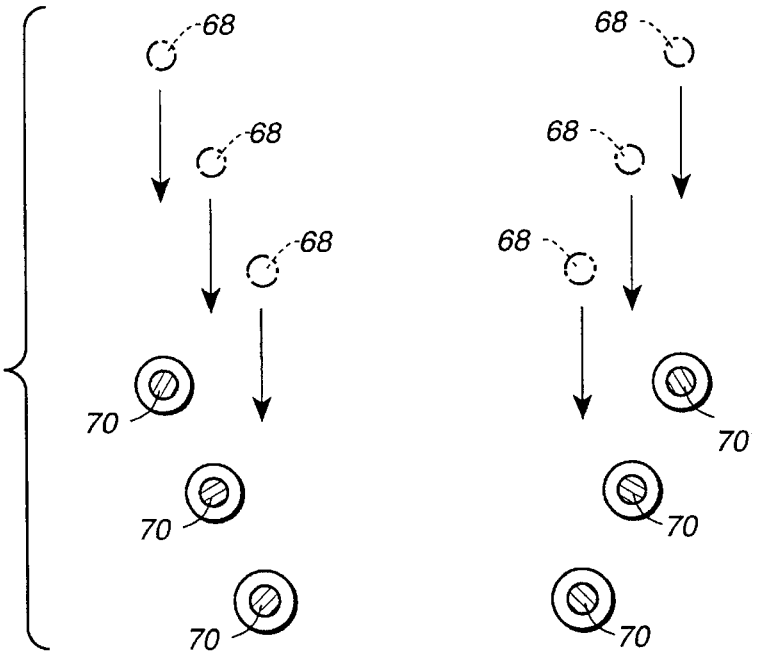
FIG. 13 is a plan projection view of the connector conductor contacts in two positions before and after contact with receiving contact faces of the receptacle taken along line 13—13 of FIG. 9.

With reference to the plan view of FIG. 13, the dashed circles and directional arrows indicate the paths taken by the sliding contact points 70*a* moving longitudinally toward the contact surfaces 88 prior to contact. Final connection is achieved when respective conductors 68, shown as hatched circles, are within the corresponding contact surfaces 88.

Removal of the connector 50 is accomplished by grasping the handle 62 and deflecting the handle 62 away from the upper wall 74 until the notches 67 are free from the ridges 83, then pulling proximally and toward the receptacle lower wall 73 while pulling proximally along the longitudinal axis until the connector 50 is separated from the receptacle 52.

While the foregoing detailed description has described one embodiment of the resilient body connector system in accordance with this invention, it is to be understood that the above description is illustrative only and not limiting of the disclosed invention. It will be appreciated that it would be possible to modify the materials, shapes and dimensions of the connector and receptacle system of this invention or to include or exclude various elements within the scope and spirit of this invention. For less demanding applications, the gasket layer could be eliminated. More or fewer conductors could be provided in the conductor body and receptacle mating interface.

Multiple mating interfaces could be defined on the connector body and receptacle and disposed, for example in offset parallel planes or opposed surfaces having bi-lateral symmetry about a central axis. The shape and dimensions of the spring and direction of latching spring handle could be altered and the shape and dimensions of the guide ramps and faces could be altered to present connector-receptacle pairs having different configurations, while continuing to use similar materials, conductor component piece parts and methods of manufacture to lower overall cost.

An alternative connector of the present invention, without a sealing gasket could be used in less demanding environments. Alteratively, a connector of this invention could eliminate an elastomer layer filling in concavities in applications not requiring such measures. The geometry of the guiding, locating and latching means may use different shapes such as notches, grooves, channels and the like which are derived from molds easily machined by simple tool shapes thereby minimizing setup and tooling costs. Thus the invention is to be limited only by the claims as set forth below.

We claim:

1. An electrical connector assembly for making separable electrical connections, the assembly having resistance to external moisture and contamination, comprising:

a resilient insulating connector body defining a longitudinal axis, the connector body including a resilient gasket layer and a contiguous resilient second body member, the resilient gasket layer having one side defining a slidably smooth outward facing connector mating interface, the gasket layer having the other side bonded to the second body member disposed between the connector mating interface and the second body member;

a receptacle having a complementary mating interface for slidably receiving the connector mating interface as the connector is moved along the longitudinal axis;

a plurality of spaced apart first electrical conductors, each conductor having one end with a corresponding contact point, and a corresponding opposed connection end, a portion of each of the conductors and each connection end being embedded within the second body member, each of the respective conductor contact points protruding outside the second body member and disposed in the interior of a corresponding recess opening provided in the resilient gasket layer and connector mating interface, the contact points aligned in a plane parallel to the connector mating interface;

guide means for urging the connector body toward the connector mating interface such that the connector mating interface and the respective conductor contact points will simultaneously make intimate sliding contact with the receptacle complementary mating interface by compressing the gasket layer against the receptacle complementary mating interface as the connector body is slidably moved longitudinally with respect to the receptacle complementary mating surface;

a plurality of corresponding spaced apart second electrical conductors embedded in the receptacle, each second electrical conductor defining a corresponding planar contact surface, the respective contact surfaces disposed along the receptacle complementary mating interface to slidably receive the corresponding connector contact points thereon, as the connector body is slidably moved into a contact position;

latching means for removably latching the connector body in registration with the receptacle such that the respective conductor contact points are aligned in contacting opposition with the corresponding receptacle second contact surfaces at the contact position;

whereby good electrical contact is provided between each respective connector contact point and each corresponding receiving contact surface, and each electrical contact is sealed from external moisture and contamination.

2. An electrical connector assembly as set forth in claim 1 wherein:

the gasket layer has a selected Shore hardness in the range of about 35 to 60 Shore A.

3. An electrical connector assembly as set forth in claim 1 wherein:

the second body has a selected Shore hardness in the range of about 70 to 90 Shore A.

4. An electrical connector assembly as set forth in claim 1 wherein:

the portion of each of the first electrical conductors embedded in the connector body each forms a waterproof seal between the portion and the second body.

5. An electrical connector assembly as set forth in claim 4 wherein:

the waterproof seal is formed by an adhesive layer between the portion of the electrical conductor and the second body.

6. An electrical connector assembly as set forth in claim 5 wherein:

the waterproof seal is formed by a thermosetting compound between the portion of the electrical conductor and the second body.

7. An electrical connector assembly as set forth in claim 1 wherein:

the first electrical conductors define respective smooth semi-circular contours, having the respective contact points thereon, the contours parallel to the longitudinal axis.

8. An electrical connector assembly as set forth in claim 1, further comprising:

a flexible wiper member distally positioned on the connector body and projecting beyond the connector mating interface such that the receptacle complementary mating interface and the second contact surfaces will be substantially wiped free of adherent materials when the connector is slidably positioned in the receptacle.

9. An electrical connector assembly as set forth in claim 8, wherein:

the wiper member includes a plurality of corrugated ribs extending laterally at least as wide as the most extreme lateral extent of the corresponding receptacle contact faces.

10. An electrical connector assembly as set forth in claim 8, wherein:

the receptacle defines an distally disposed outlet for receiving adherent materials removed by the wiper when the connector is inserted in the receptacle.

11. An electrical connector assembly as set forth in claim 1, wherein:

the protruding first electrical conductors are elongated cylindrical pins.

12. An electrical connector assembly, as set forth in claim 11, wherein:

the connector second body member includes a semi-rigid insulating matrix sheet having the pins embedded perpendicularly therethrough, the matrix sheet providing essentially rigid lateral support to the pins relative to each other along the plane of the sheet, and the sheet being suitably flexible in a direction perpendicular to the sheet for displacement of the pins relative to each other from forces exerted along the axes of the pins.

13. An electrical connector assembly as set forth in claim 1 wherein:

the second body member having a selected Shore hardness, is shaped and dimensioned to provide, in cooperation with a complementary shaped and dimensioned guide means, a normal force for holding the first electrical contacts against the second contact surfaces, when the connector is inserted in the receptacle.

14. An electrical assembly as set forth in claim 13, wherein the Shore hardness of the second body is selected to be in the range of about 70 to 90 Shore A.

15. An electrical connector assembly as set forth in claim 1, wherein:

the latching means for holding the connector body in registration with the receptacle in the contact position includes a spring member molded in the connector body, the spring member shaped and dimensioned for cooperating with the receptacle, when the connector is inserted in the receptacle.

16. An electrical connector assembly as set forth in claim 15, wherein:

the receptacle includes a latching ridge facing inward to the receptacle mating interface; the spring member includes a locking edge for removably locking with the latching ridge, when the connector is located in the contact position, whereby the connector is removably locked in connecting position with the receptacle.

17. Any one of claims 15 or 16 wherein re-entrant concavities formed within the spring member and between the spring member and the second body are covered with a third elastomeric surface layer such that moisture and other adherent materials are excluded therefrom, except for the gasket layer recesses.

18. An electrical connector assembly for making separable electrical connections, the assembly having resistance to external moisture and contamination, comprising:

a resilient insulating connector body defining a longitudinal axis, the connector body including a resilient second body member, having one side defining a outward facing connector mating interface, a plurality of spaced apart first electrical conductors, each conductor having one end with a corresponding contact point, and a corresponding opposed connection end, a portion of each of the conductors and each connection end being embedded within the second body member, each of the respective conductor contact points protruding outside the second body member and the contact points aligned in a plane parallel to the connector mating interface;

a receptacle having a complementary mating interface for slidably receiving the conductor contact points as the connector is moved along the longitudinal axis;

guide means for urging the connector body toward the connector mating interface such that the respective conductor contact points will make intimate sliding contact with the receptacle complementary mating interface as the connector body is slidably moved longitudinally with respect to the receptacle complementary mating surface;

a plurality of corresponding spaced apart second electrical conductors embedded in the receptacle, each second electrical conductor defining a corresponding planar contact surface, the respective contact surfaces disposed along the receptacle complementary mating interface to slidably receive the corresponding connector contact points thereon, as the connector body is slidably moved into a contact position;

latching means for removably latching the connector body in registration with the receptacle such that the respective conductor contact points are aligned in contacting opposition with the corresponding receptacle second contact surfaces at the contact position;

whereby good electrical contact is provided between each respective connector contact point and each corresponding receiving contact surface.

19. An electrical connector assembly as set forth in claim 18 wherein:

the second body has a selected Shore hardness in the range of about 70 to 90 Shore A.

20. An electrical connector assembly as set forth in claim 18 wherein:

The portion of each of the first electrical conductors embedded in the connector body each forms a waterproof seal between the portion and the second body.

21. An electrical connector assembly as set forth in claim 20 wherein:

the waterproof seal is formed by an adhesive layer between the portion of the electrical conductor and the second body.

22. An electrical connector assembly as set forth in claim 21 wherein:

the waterproof seal is formed by a thermosetting compound between the portion of the electrical conductor and the second body.

23. An electrical connector assembly as set forth in claim 18 wherein:

the first electrical conductors define respective smooth semi-circular contours, having the respective contact points thereon, the contours parallel to the longitudinal axis.

24. An electrical connector assembly as set forth in claim 18, further comprising:

a flexible wiper member distally positioned on the connector body and projecting beyond the connector mating interface such that the receptacle complementary mating interface and the second contact surfaces will be substantially wiped free of adherent materials when the connector is slidably positioned in the receptacle.

25. An electrical connector assembly as set forth in claim 24, wherein:

the wiper member includes a plurality of corrugated ribs extending laterally at least as wide as the most extreme lateral extent of the corresponding receptacle contact faces.

26. An electrical connector assembly as set forth in claim 24, wherein:

the receptacle defines an distally disposed outlet for receiving adherent materials removed by the wiper when the connector is inserted in the receptacle.

27. An electrical connector assembly as set forth in claim 18, wherein:

the protruding first electrical conductors are elongated cylindrical pins.

28. An electrical connector assembly, as set forth in claim 27, wherein:

the connector second body member includes a semi-rigid insulating matrix sheet having the pins embedded perpendicularly therethrough, the matrix sheet providing essentially rigid lateral support to the pins relative to each other along the plane of the sheet, and the sheet being suitably flexible in a direction perpendicular to the sheet for displacement of the pins relative to each other from forces exerted along the axes of the pins.

29. An electrical connector assembly as set forth in claim 18 wherein:

the second body member having a selected Shore hardness, is shaped and dimensioned to provide, in cooperation with a complementary shaped and dimensioned guide means, a normal force for holding the first electrical contacts against the second contact surfaces, when the connector is inserted in the receptacle.

30. An electrical assembly as set forth in claim 29, wherein the Shore hardness of the second body is selected to be in the range of about 70 to 90 Shore A.

31. An electrical connector assembly as set forth in claim 18, wherein:

the latching means for holding the connector body in registration with the receptacle in the contact position includes a spring member molded in the connector body, the spring member shaped and dimensioned for cooperating with the receptacle, when the connector is inserted in the receptacle.

32. An electrical connector assembly as set forth in claim 31, wherein:

the receptacle includes a latching ridge facing inward to the receptacle mating interface; the spring member includes a locking edge for removably locking with the latching ridge, when the connector is located in the contact position, whereby the connector is removably locked in connecting position with the receptacle.

33. Any one of claims 31 or 32 wherein re-entrant concavities formed within the spring member and between the spring member and the second body are covered with a third elastomeric surface layer such that moisture and other adherent materials are excluded therefrom, except for the gasket layer recesses.

* * * * *